US005378296A

United States Patent [19]

Vesa

[11] Patent Number: 5,378,296

[45] Date of Patent: Jan. 3, 1995

[54] APPARATUS AND PROCESS FOR THE PRODUCTION OF SEAT PAD PARTS FROM LOOSE PADDING RAW MATERIAL

[76] Inventor: Juha Vesa, Palokärjenkatu 14 D, SF-20610 Turku, Finland

[21] Appl. No.: 965,365

[22] PCT Filed: Jun. 6, 1991

[86] PCT No.: PCT/FI91/00178

§ 371 Date: Dec. 17, 1992

§ 102(e) Date: Dec. 17, 1992

[87] PCT Pub. No.: WO91/18828

PCT Pub. Date: Dec. 12, 1991

[30] Foreign Application Priority Data

Jun. 8, 1990 [FI] Finland ..... FI 902887

[51] Int. Cl.[6] ..... B68G 11/03

[52] U.S. Cl. ..... 156/62.6; 156/62.2; 156/285; 156/296; 156/308.2; 156/245; 19/148; 425/80.1; 264/121; 264/122

[58] Field of Search ..... 156/62.2, 62.6, 62.8, 156/296, 285, 309.6, 308.2, 245, 242; 264/121, 122; 19/148; 425/80.1

[56] References Cited

U.S. PATENT DOCUMENTS

| | | | |
|---|---|---|---|
| 2,357,392 | 9/1944 | Francis, Jr. | 264/122 X |
| 2,543,101 | 2/1951 | Francis, Jr. | 264/122 X |
| 3,032,774 | 5/1962 | Wade | 19/148 |
| 4,520,066 | 5/1985 | Athey . | |
| 5,064,484 | 11/1991 | Craig et al. | 156/62.2 X |

FOREIGN PATENT DOCUMENTS

| | | |
|---|---|---|
| WO86/06114 | 10/1986 | WIPO . |
| WO88/05421 | 7/1988 | WIPO . |

*Primary Examiner*—Jeff H. Aftergut
*Attorney, Agent, or Firm*—Nixon & Vanderhye

[57] ABSTRACT

The invention relates to an apparatus for the production of formed parts for use as pads in seats, for instance. The object is to provide a new apparatus with a different operating principle by means of which formed parts in which the density of the padding is uniform can be produced. The apparatus according to the invention comprises devices known per se for opening padding raw material into a desired looseness and for transporting it into a weighing device and for transferring the weighed batch of padding material into a filling chamber by means of a suction created by a vacuum pressure acting on the filling chamber. A porous mould through which the suction acts is positioned in the filling chamber for receiving the batch of padding material; that the padding raw material is at least partly formed of binding fibres melting under the influence of heat; and that the filling chamber is connected with means for introducing hot air through the mould and the batch of padding material contained in it for melting the binding fibre material of the batch of padding material at least partly, and thereafter for introducing cold air through the mould and the batch of padding material contained therein for solidifying the batch.

20 Claims, 2 Drawing Sheets

APPARATUS AND PROCESS FOR THE PRODUCTION OF SEAT PAD PARTS FROM LOOSE PADDING RAW MATERIAL

The invention relates to an apparatus for formed parts used as pads in seats, for instance.

In such formed parts, which are used e.g. in seats and backs produced by the furniture and car industry, the pad is usually formed of fibres which harden under the combined action of heat and compression into a shape determined by the press. The production has previously been carried out by placing a so-called cut block usually regular in shape and made of a padding material of uniform density in a press mould which presses the block into the desired shape with simultaneous heating.

A drawback is that the density of the padding is no longer even in the finished formed part; the density is considerably greater in the thinner portions of the formed part as compared with the thicker portions.

The object is to provide a new apparatus with a different operating principle, which apparatus enables the production of formed parts in which the density of the padding material is uniform.

The apparatus according to the invention is mainly characterized in that it comprises devices known per se for opening padding raw material into a desired looseness and for transporting it into a weighing device and for transferring the weighed batch of padding material into a filling chamber by means of a suction created by a vacuum pressure acting on the filling chamber; and that a porous mould through which the suction acts is positioned in the filling chamber for receiving the batch of padding material; that the padding raw material is at least partly formed of binding fibres melting under the influence of heat; and that the filling chamber is connected with means for first introducing hot air through the mould and the batch of padding material contained in it for melting the binding fibre material of the batch of padding material at least partly, and thereafter for introducing cold air through the mould and the batch of padding material contained therein for solidifying the batch.

To ensure that the mould is filled evenly so that the density of the padding material will be uniform, it is preferable to position the porous mould in the filling chamber in such a way that the vacuum pressure is equal on all sides of the mould. The padding is preferably of fibre material comprising a matrix fibre and a binding fibre melting at a lower temperature than the matrix fibre.

Since hot air is sucked through the porous fibre material and the mould, the entire fibre material reaches a uniform temperature rapidly. The binding fibres melt, forming bonds between the fibres through the entire fibre material layer. Correspondingly, cooling air is also sucked through the entire fibre structure, so that the cooling is rapid. Molten binding fibres get a fixed shape and the bonds become permanent.

In addition to the even density of the padding material of the finished formed parts, one important advantage of the invention is that the feeding of the fibre is carried out in the same apparatus as the thermal binding and moulding. The vacuum filling of the fibre enables the filling to be carried out with uniform density, and the density is adjustable by varying the vacuum pressure. If required, a fairly high filling density can be achieved.

In the following, the invention will be described in greater detail with reference to the embodiment shown schematically in the attached drawing.

Figure 1:
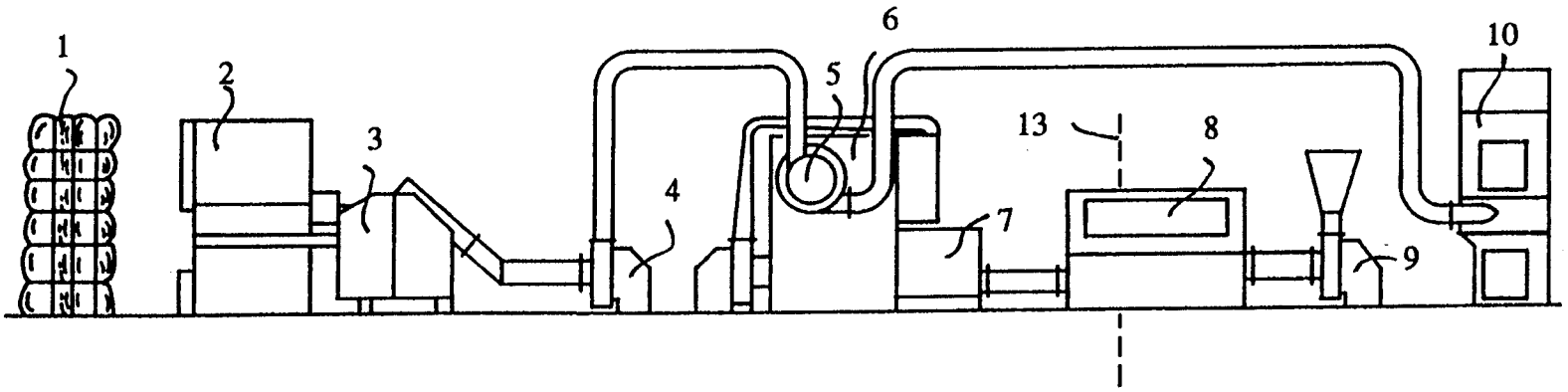
FIG. 1 is a general side view of the structure of the apparatus.

In FIG. 1, the reference numeral 1 indicates fibre material bales which are opened to a desired looseness in a manner known per se in devices 2 and 3. Through a blower 4 the padding material proceeds as a free mass flow into a cyclone 5, under which a volumetric feed box 6 is positioned, into a weighing device 7 which is controlled by a microprocessor. 8 indicates a filling device, 9 a suction blower and 10 a dust receiving bag or the like.

From the cyclone 5, pure padding material passes into the weighing device 7 controlled by the microprocessor, and after having received one batch of padding material, the weighing device feeds the batch by means of the blower 9 positioned at the backward end into the filling device 8.

In these respects the general structure of the apparatus may be similar to the device for the production of pillows disclosed in International Patent Application WO 88/05421.

Figure 2:
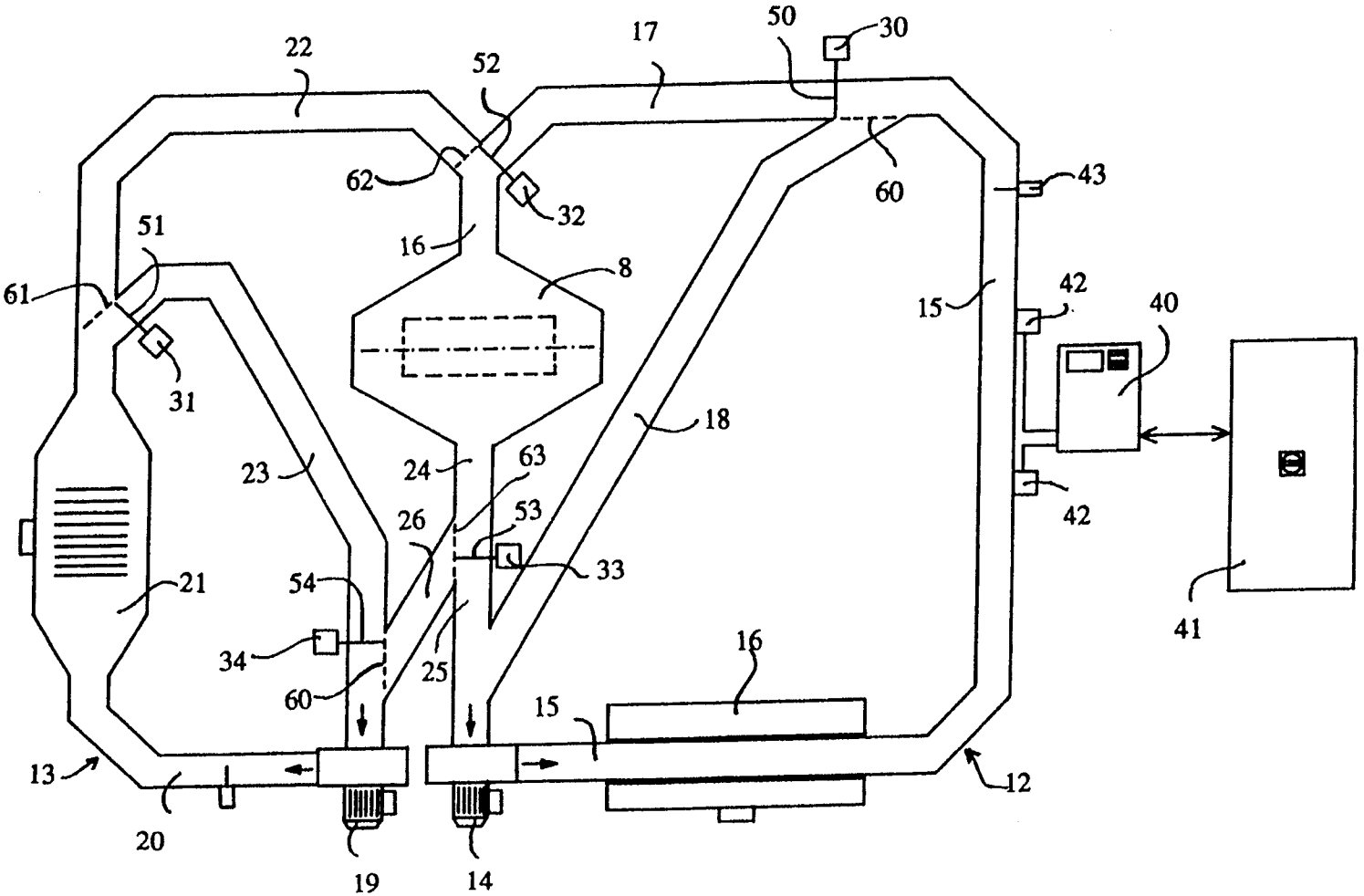
FIG. 2 is a more detailed view of the filling and moulding part of the apparatus.

In FIG. 2, the reference numeral 11 indicates a mould made of a porous material and positioned in the filling chamber 8 in such a way that the vacuum pressure prevailing in the chamber 8 acts on the mould on all sides. As the vacuum pressure is uniform on all sides of the mould 11, the mould is filled evenly and the density of the padding material is at least substantially uniform. The filling density is adjustable by varying the vacuum pressure of the chamber 8. When the mould 11 is full, the vacuum pressure valve of the chamber 8, which is not shown in FIG. 2, is closed.

After filling, the mould 11 is kept in the chamber 8 and hot air is introduced into the chamber by means of a circuit 12. Hot air is sucked through the batch of porous fibrous padding material and the mould 11. The fibrous padding material is preferably such that some of the fibres melt at a lower temperature than the others.

As the hot air for melting is sucked through the fibrous material, the material achieves rapidly a uniform temperature. The melting part becomes adhesive, thus forming bonds between the fibres. Due to the through flow, bonds are formed throughout the material layer.

Thereafter cooling air is passed into the chamber 8 by means of a circuit 13. As the temperature drops, the molten part again gets a fixed shape and the bonds become permanent. The cold air also passes through the material, so that the cooling is rapid.

After cooling, the chamber 8 is opened and the used mould and the bonded product contained therein are removed. The product now has a permanent shape determined by the mould.

The product may be e.g. a seat cushion for a piece of furniture, whereby the product may be covered with a coating material resistant to high temperatures already at the filling stage.

In the exemplifying embodiment shown in FIG. 2, the hot air circuit 12 comprises a blower 14 from which an air channel 15 is arranged to extend through a heating device 16. The channel 15 is divided into a branch 17 leading into an inlet opening 16 of the filling chamber 8 and into a branch 18 leading into the blower 14 past the chamber 8.

Correspondingly, the cold air circuit 13 comprises a blower 19 from which an air channel 20 is arranged to extend through a cooling device 21. After the cooling device the channel 20 is divided into a branch 22 leading into the inlet opening 16 of the filling chamber 8 and into a branch 23 leading into the blower 19 past the chamber 8.

An outlet opening 24 of the filling chamber 8 communicates with the blower 14 through a channel 25 and with the blower 19 through a channel 26.

Control plates 30, 31, 32, 33 and 34 are positioned at the branching point of the channel 15, at the branching point of the channel 20, at the junction of the channel branches 17 and 22 before the inlet opening 16 of the chamber 8, at the branching point of the channels 25 and 26 after the outlet opening 24 of the chamber 8, and at the junction of the channel branch 23 and the channel 26 before the blower 19, respectively.

The reference numeral 40 indicates a control unit, the reference numeral 41 a switchboard, the reference numerals 42 pressure gauges, and the reference numeral 43 a temperature sensor.

FIG. 2 illustrates the cooling step, that is, the control plates 30 and 32 close the channel branch 17, the control plate 31 closes the channel branch 23, the control pate 33 closes the channel 25, and the control plate 34 closes the channel branch 23. The closing positions are indicated with solid lines with the reference numerals 50, 52, 51, 53 and 54, respectively. The cooling air circulates along a path blower 19-channel 20-cooling device 21-channel branch 22-filling chamber 8 with its moulds 11-channel 26-blower 19. Hot air passes by the filling chamber 8 through the channel branch 18.

At the heating step, the control plates 30, 31, 32, 33 and 34 are correspondingly in positions 60, 61, 62, 63 and 64 indicated with broken lines. The hot air circulates along a path blower 14-channel 15-heating device 16-channel branch 17-filling chamber 8 with its moulds 11-channel 25-blower 14, and cold air passes by the chamber 8 through the channel branch 23.

The moulding apparatus shown in FIG. 2 is preferably transverse to the plane of FIG. 1, wherefore the apparatus of FIG. 2 is only outlined by a broken line 13 in FIG. 1.

I claim:

1. A method for producing seat pad parts utilizing a porous mold and loose padding raw material, comprising the steps of sequentially:

(a) introducing a single batch of loose padding material, formed at least in part of meltable binding fibers, into the mold, the batch of sufficient volume to substantially fill the mold;

(b) introducing hot air through the mold and the batch of padding material contained therein to raise the padding material temperature to above the melting temperature of the binding fibers to effect at least partial melting of the binding fibers in the mold;

(c) passing cooling air through the mold so as to solidify the batch of padding material into a part useful as a seat pad; and (d) removing the solidified part from the mold.

2. A method as recited in claim 1 wherein steps (a)–(c) all are practiced in a common chamber.

3. A method as recited in claim 2 wherein step (a) is practiced so as to fill the mold with padding raw material comprising a matrix fiber and a binder fiber which has a lower melting temperature than the matrix fiber; and wherein step (b) is practiced so that the temperature of the mold remains below the melting temperature of the matrix fiber.

4. A method as recited in claim 2 wherein step (a) is practiced by applying a vacuum so that it acts on all sides of the mold to effect uniform filling of the mold with loose padding material.

5. A method as recited in claim 1 wherein step (a) is practiced by applying a vacuum so that it acts on all sides of the mold to effect uniform filling of the mold with loose padding material.

6. A method as recited in claim 5 wherein step (a) is practiced so as to fill the mold with padding raw material comprising a matrix fiber and a binder fiber which has a lower melting temperature than the matrix fiber; and wherein step (b) is practiced so that the temperature of the mold remains below the melting temperature of the matrix fiber.

7. A method as recited in claim 1 wherein step (a) is practiced so as to fill the mold with padding raw material comprising a matrix fiber and a binder fiber which has a lower melting temperature than the matrix fiber; and wherein step (b) is practiced so that the temperature of the mold remains below the melting temperature of the matrix fiber.

8. A method as recited in claim 1 comprising the further step of weighing the padding material to determine that the batch is of sufficient size to substantially fill the mold prior to step (a).

9. Apparatus for the production of seat pads for use in seats, comprising:

a supply of padding material, including binder fibers;

a weighing device;

means for transporting padding material from said supply to said weighing device;

a stationary porous mold having a surface area, said mold disposed within a filling chamber and said mold porous over substantially the entire surface are thereof;

means for applying a vacuum to said filling chamber over substantially the entire surface area of the mold;

means for transporting weighed padding material from said weighing device to said mold for filling said mold;

means for blowing hot air through said mold to melt the binder fiber component of the padding material in said mold; and means for blowing cooling air through said mold.

10. Apparatus as recited in claim 9 wherein said means for blowing hot air comprises a first blower and a hot air circuit; and wherein said means for blowing cooling air comprises a second blower and a cooling air circuit.

11. Apparatus as recited in claim 10 further comprising valve means for selectively connecting said hot air circuit or said cooling air circuit to said filling chamber.

12. Apparatus as recited in claim 11 wherein said padding material supply comprises means for opening padding material fibers.

13. Apparatus as recited in claim 10 wherein said hot air circuit comprises a hot air conduit, and an air heater disposed in said hot air conduit.

14. Apparatus as recited in claim 10 wherein said cooling air circuit comprises a cooling air conduit, and an air cooling means disposed in said cooling air conduit.

15. Apparatus as recited in claim 9 wherein said padding material supply comprises means for opening padding material fibers.

16. A method for producing seat pads utilizing a porous mold having a plurality of sides, and loose padding raw material, comprising the steps of sequentially:

(a) introducing a batch of loose padding material, formed at least in part of meltable binding fibers, into the mold by applying a vacuum acting on all sides of the mold so as to evenly fill the mold so that the density of the padding material is substantially uniform throughout the mold;

(b) while maintaining the mold stationary, introducing hot air through the mold and batch of padding material contained therein to raise the padding material temperature to above the melting temperature of the binding fibers to effect at least partial melting of the binding fibers in the mold;

(c) passing cooling air through the mold so as to solidify the batch of padding material into a seat pad; and (d) removing the seat pad from the mold.

17. A method as recited in claim 16 wherein step (a) is further practiced by introducing a single batch of padding material into the mold, the batch having a sufficient volume to substantially fill the mold, and to provide all of the material necessary to form the seat pad.

18. A method as recited in claim 17 comprising the further step of weighing the padding material to determine that the batch is of sufficient size to substantially fill the mold prior to step (a).

19. A method as recited in claim 16 wherein steps (a)–(c) all are practiced in a common chamber.

20. A method as recited in claim 16 wherein step (a) is practiced so as to fill the mold with padding raw material comprising a matrix fiber and a binder fiber which has a lower melting temperature than the matrix fiber; and wherein step (b) is practiced so that the temperature of the mold remains below the melting temperature of the matrix fiber.

* * * * *